US010494747B2

(12) United States Patent
Atmanspacher

(10) Patent No.: US 10,494,747 B2
(45) Date of Patent: Dec. 3, 2019

(54) CIRCULAR-KNITTED PART AND METHOD FOR THE PRODUCTION OF SAME

(71) Applicant: medi GmbH & Co. KG, Bayreuth (DE)

(72) Inventor: Jan Atmanspacher, Warmensteinach (DE)

(73) Assignee: MEDI GMBH & CO. KG, Bayreuth (DE)

( * ) Notice: Subject to any disclaimer, the term of this patent is extended or adjusted under 35 U.S.C. 154(b) by 165 days.

(21) Appl. No.: 15/434,679

(22) Filed: Feb. 16, 2017

(65) Prior Publication Data

US 2017/0247822 A1 Aug. 31, 2017

(30) Foreign Application Priority Data

Feb. 26, 2016 (DE) ..... 10 2016 103 421

(51) Int. Cl.
*D04B 1/26* (2006.01)
*D04B 1/10* (2006.01)

(52) U.S. Cl.
CPC ..... *D04B 1/26* (2013.01); *D04B 1/108* (2013.01); *D04B 1/265* (2013.01)

(58) Field of Classification Search
CPC . D04B 1/26; D04B 1/108; D04B 1/22; D04B 1/265
See application file for complete search history.

(56) References Cited

U.S. PATENT DOCUMENTS 1,976,885 A * 10/1934 Levin ..... D04B 1/00 66/190
2,033,096 A * 3/1936 Drumheller ..... D04B 1/18 66/190
2,102,369 A * 12/1937 Martel ..... D04B 1/26 66/172 E
2,166,166 A * 7/1939 Larkin ..... D04B 1/10 66/170
2,171,445 A * 8/1939 Getaz ..... D04B 1/18 66/135
2,228,208 A * 1/1941 Getaz ..... D04B 1/18 66/190
2,306,914 A * 12/1942 Smith, Jr. ..... D04B 9/54 66/172 E (Continued)

FOREIGN PATENT DOCUMENTS

CA 2865963 A1 9/2013
DE 628904 C 4/1936

(Continued)

*Primary Examiner* — Danny Worrell
(74) *Attorney, Agent, or Firm* — Lucas & Mercanti, LLP

(57) ABSTRACT

A circular-knitted part, with a base knitted material knitted with at least one base knitting yarn, the base material having several rows of stitches which are knitted together when seen in the longitudinal direction of the base knitted material and which extend circumferentially in spiral fashion, wherein, seen in the longitudinal direction of the base knitted material, an additional yarn, which forms stitches, is interknitted between two rows of stitches of the base knitted material, thus connecting the rows of stitches together, to form at lease on additional stitch, wherein the additional stitch is formed by at least one separate additional yarn.

18 Claims, 3 Drawing Sheets

(56) References Cited

U.S. PATENT DOCUMENTS 2,319,768 A * 5/1943 Beers ..... D04B 1/26 66/169 R
2,349,746 A * 5/1944 Morris ..... D04B 1/26 66/172 E
2,378,780 A * 6/1945 Lombardi ..... D04B 1/18 66/176
2,384,392 A * 9/1945 Page ..... D04B 9/54 66/172 E
3,241,340 A 3/1966 Knohl
3,461,695 A * 8/1969 Knohl ..... D04B 1/24 66/178 A
3,561,441 A * 2/1971 Lombardi ..... A61F 13/00017 602/43
3,603,116 A * 9/1971 Turini ..... D04B 1/108 66/178 R
3,654,054 A * 4/1972 Waller ..... D04B 1/02 28/160
3,683,116 A 8/1972 Dill
3,964,277 A * 6/1976 Miles ..... D04B 9/16 66/190
4,015,448 A * 4/1977 Knohl ..... D04B 9/52 66/178 A
4,036,037 A * 7/1977 Huckfeldt ..... A22C 13/00 66/170
4,104,892 A * 8/1978 Thorneburg ..... A41B 11/02 2/239
4,237,707 A * 12/1980 Safrit ..... D04B 1/18 66/172 E
4,615,056 A 10/1986 Grant
4,663,946 A * 5/1987 Wright ..... D04B 1/108 66/177
4,732,015 A * 3/1988 Abrams ..... A41B 11/02 66/172 E
2,229,105 A 1/1997 Lombardi
5,592,836 A 1/1997 Schuster et al.
5,615,562 A * 4/1997 Roell ..... D04B 1/123 66/126 R
6,263,707 B1 * 7/2001 Miller ..... D04B 1/18 66/171
7,043,329 B2 * 5/2006 Dias ..... D04B 7/32 66/55
9,506,172 B2 11/2016 Atmanspacher

FOREIGN PATENT DOCUMENTS

DE 1585117 A1 1/1970
DE 1911101 A 9/1970
DE 10316979 A1 11/2004
DE 202004003417 U1 7/2005
DE 102011003414 A1 8/2012
EP 0845553 A1 6/1998
EP 2792774 A1 10/2014
FR 2781816 A1 2/2000
GB 521090 A 5/1940
GB 714581 A 9/1954

* cited by examiner

CIRCULAR-KNITTED PART AND METHOD FOR THE PRODUCTION OF SAME

CROSS-REFERENCE TO RELATED APPLICATIONS

The present application claims priority of DE 10 2016 103 421.5, filed Feb. 26, 2016, the priority of this application is hereby claimed and this application is incorporated herein by reference.

BACKGROUND OF THE INVENTION

The invention pertains to a circular-knitted part, with a base knitted material knitted with at least one base knitting yarn, the base material consisting of several rows of stitches which, when seen in the longitudinal direction of the base knitted material, are knitted together and extend circumferentially in spiral fashion.

Circular-knitted parts of this type are known in the form of, for example, a foot or leg stocking, an arm stocking, a body part, a bandage, or the like. They consist of a base knitted material, which is knitted from at least one base knitting yarn such as a yarn made of PA, PES, PP, or a natural fiber such as cotton or silk, wherein, in addition, two or more base knitting yarns can be knitted together. Rows of stitches are knitted in a spiral pattern, so that, overall, a tubular circular-knitted part is obtained. If an elastic yarn is also either inlaid as a weft yarn or knitted concomitantly, the circular-knitted part acquires properties which can extend from merely elastic to compression-producing, as is necessary in the therapeutic field, for example.

On occasion it is desirable to give a certain area of a circular-knitted part of this type a certain function, so that it can serve as, for example, a type of cushion section or plush section; the body region covered by this section such as a joint or a sensitive area of skin can thus be cushioned by it and protected from excessive stress. On occasion it is also desirable for the circular-knitted part itself to simulate an anatomical body shape, i.e., for the part to be configured geometrically in a certain way, such as when the circular-knitted part is to be pulled over a joint, so that the fit and wearing comfort can be improved and the formation of folds can be reduced. A knitted part in which a soft-to-the-touch, plush-like and thus cushioning section is provided and which is knitted in such a way that a geometric effect to adapt the part to the shape of the body is obtained is known from, for example, EP 2 792 774 A1. To form the area with a pleasant feel, an appropriate increase in the number of float stitches is provided, whereas, to change the geometry, the corresponding area is knitted in a flat manner, so that the number of stitches in the base knitted material can be increased and thus a greater knitting volume obtained.

SUMMARY OF THE INVENTION

The invention is based on the problem of providing a base knitted material in which a function-oriented or geometry-oriented area can be easily realized.

To solve this problem, in the case of a circular-knitted part of the type indicated above, it is provided according to the invention that, looking in the longitudinal direction of the base knitted material, a stitch-forming additional yarn is interknitted between two rows of stitches of the base knitted material and connects the rows together to form at least one additional stitch, wherein the additional stitch is formed by at least one separate additional yarn.

In the circular-knitted part according to the invention, which comprises no longitudinal seam, an additional yarn is used to interknit locally at least one additional stitch between two adjacent rows of stitches of the base knitted material adjoining each other in the longitudinal direction of the base material, each row consisting of several stitches. This additional stitch is therefore knitted between the two stitches of the stitch rows of the base knitted material, this additional stitch connecting the stitches of the two rows of stitches of the base material. In relation to a wale, therefore, the number of stitches per wale is increased by the interknitting of the additional stitch. Looking in the longitudinal direction of the knitted material, corresponding additional stitches can be knitted in certain areas between several such pairs of stitch rows of the base knitted material to form a corresponding region of larger surface area, wherein each additional stitch is formed by its own, separate additional yarn. Corresponding rows of additional stitches are therefore formed in each wale also. Several additional stitches can also be knitted in certain sections between two rows of stitches of the base knitted material when seen in the circumferential direction of the knitted material, wherein the individual additional stitches are formed by separate additional yarns, or several or all additional stitches are formed by a common additional yarn. This, too, leads to the formation of an additional row of stitches, in this case between two rows of stitches of the base knitted fabric seen the circumferential direction. As a result, it is possible to produce one or more defined, delimited regions or sections which extend in the longitudinal direction and in the circumferential direction of the knitted material and which, in addition to the stitches of the base knitted material, contain the additional stitches as well. The larger the number of additional stitches provided in the circumferential direction, the wider the specific region realized in this way, seen in the circumferential direction, can be. The larger the number of additional stitches realized in the longitudinal direction of the knitted material, the taller the specific region executed in this way can be. Each additional yarn begins and ends in each case between two rows of stitches of the base knitted material; it therefore does not extend around the circumference along with the yarn of the base knitted material.

By interknitting the additional yarns, i.e., through the formation of the additional stitches or additional rows of stitches, what is realized is therefore a larger number of stitches in certain areas of the circular-knitted part and a smaller number in others. The number of stitches is therefore increased only locally by the additional stitches. The additional stitches are, as described, knitted as stitches additionally between the stitches of the base knitted material, connecting the stitches of that material, which is to say that they are neither interknitted into the stitches of the base knitted material to form a plating nor knitted on afterwards.

A series of advantages are obtained from this. First, by means of the additional stitches or additional yarns, it is possible to realize, for example, a region with a different tactile feel than that of the base knitted material; this can be, for example, a cushioning, plush-like, or soft region, resulting from the increased, additional volume and sometimes also resulting from the type or quality of the knitted additional yarn. It is possible, for example, to realize a local cushioning section, which cushions a joint or an area of irritated skin, or the like.

In addition, there is also the possibility of treating locally a covered skin area by interknitting a therapeutically active yarn. For example, a silver yarn, which has an antibacterial effect, can be interknitted as the additional yarn. Other yarns which are provided with a therapeutic active ingredient can also be interknitted, so that the active ingredient is delivered to the area of the body to be treated while the circular-knitted part is being worn.

The interknitting of the additional stitches, i.e., of the additional yarns, therefore offers the possibility of forming a function-oriented region.

Alternatively or in addition, the interknitting of additional stitches and the increase in the stitch volume in the circumferential and/or longitudinal direction of the knitted material offer the possibility of causing a change in geometry to adapt the shape of the circular-knitted part to the anatomical shape of the body part to be covered. Thus, for example, if the circular-knitted part extends around a joint, such as in the area of a knee, an ankle, or an elbow, an appropriate local curvature can be realized. In the area of the toes as well, a corresponding geometry of the knitted material can also be provided for the treatment of a hallux valgus. This geometric adaptation can also be easily realized by the interknitting of additional stitches.

Each additional stitch or additional row of stitches between two stitch rows of the base knitted material is, as described, formed by a separate additional yarn. In the finished knitted material, therefore, a corresponding number of separate additional yarns is knitted, which offers the advantage that the additional yarn does not have to be carried along throughout the entire base knitted material but is rather interknitted only locally, where the corresponding function-oriented or geometry-oriented region is to be formed.

There are various possibilities with respect to the position where the additional stitches are interknitted between the stitch rows of the base knitted material. It is conceivable, for example, that the additional stitches could be knitted between successive stitch row pairs. In this case, therefore, the base knitted material stitches and the additional stitches alternate in the longitudinal direction of the knitted material or in the direction of the wale: a first base knitted material stitch is followed by a first additional stitch, which is followed in turn by a second base knitted material stitch, followed by a second additional stitch, which is again followed by a third base knitted material stitch, etc.

Alternatively, it is also conceivable that, again seen in the longitudinal direction of the knitted material or in the direction of the wale, the additional stitches could be knitted between stitch row pairs which are separated from each other by one or more stitch rows. In this case, therefore, the additional stitches are not knitted in alternation with the stitches of the base material; instead, two or more base material stitches are present between two additional stitches. Of course, it is conceivable that different sections of the previously described type could be formed, within a function-oriented or geometry-oriented region.

According to another alternative, it is possible that, seen in the circumferential direction, or in the direction of the wale, several additional stitches could be knitted between two stitches of the base material, these additional stitches being knitted with at least one common additional yarn or with a separate additional yarn for each one. Two or more additional stitches can therefore also be knitted between two stitches of two stitch rows of the base material.

According to an elaboration of the invention, it can be provided that, seen in the circumference direction, several additional stitch sections, each of which comprises several additional stitches, can be knitted between pairs of stitch rows of the base material. Seen in the circumferential direction, therefore, two or more regions a certain distance apart with increased stitch volume can be formed, which extend in the longitudinal and in the circumferential direction.

It can also be provided that the additional stitches connect the successive stitches of the two stitch rows. Here, therefore, the two rows of stitches of the base knitted material are completely connected by the associated row of additional stitches; the two stitch rows of the base material are therefore not connected directly to each other over the length of the additional stitch row formed out of the additional stitches. Alternatively, it is possible that the additional stitches could connect only every n-th stitch of the two stitch rows in each case, where $n \geq 2$. According to this alternative form of the invention, almost any conceivable configuration of rows is possible. For example, the additional stitches can be knitted together with every second stitch of the two stitch rows of the base material, so that, as a result, the additional stitches and the base material stitches alternate. It is also conceivable, however, that the additional stitches could be knitted only to every third or every fourth stitch of the base material, or conversely several additional stitches could be knitted in succession, after which one or more base material stitches of the two stitch rows are knitted directly to each other again, to be followed again by additional stitches, etc. Any possible variations within the region where additional stitches are interknitted can therefore be freely selected.

If the additional stitches connect only every n-th stitch of the base knitted material, the additional yarn in question preferably floats between two additional stitches, unless the individual additional stitches are knitted with separate additional yarns.

Of course, within the region of the base knitted material in which the additional yarns are knitted or the additional stitches are provided, it is possible to configure different subregions in which the additional yarns or the additional stitches are knitted to the rows of stitches of the base material in different ways. For example, it would be possible to realize at least one first subregion in which, seen in the circumferential direction, the additional yarns or additional stitches connect only every n-th stitch of the two rows of stitches, and at least one second subregion, in which the additional yarns or additional stitches connect the successive stitches of the two rows of stitches. The local arrangement of the additional stitches can also vary in the longitudinal direction of the knitted material, as described above. Different subregions are therefore formed in which different additional stitch volumes are obtained. This makes it possible, for example, to realize a transition area starting from the base knitted material in which a smaller number of additional stitches are present, and which then continues into a region with a much larger number of additional stitches. Ultimately, any possible variation can be chosen.

This also applies to the arrangement or positioning of these different subregions in the base knitted material itself. For example, the subregions can adjoin each other in the circumferential direction and/or in the longitudinal direction of the base knitted material or be separated from each other. Alternatively, the subregions can also lie in each other and be either directly adjacent to each other or separated from each other. The subregions, the edge geometry of which is ultimately of any desired type, can therefore, for example, extend horizontally next to each other or vertically above each other or at a slant or angle to each other; they can adjoin each other directly or be separated slightly from each other. They can, for example, lie in each other in a circular or ellipsoidal manner and adjoin each other directly or be somewhat separated, etc. Here, too there is an extremely wide range of possible variations.

As described, a central feature of the circular-knitted material according to the invention is that additional stitches knitted between two rows of stitches of the base knitted material or a row of additional stitches comprising one or more additional stitches are realized by means of a separate additional yarn in each case, the beginning and end of which lie in the base knitted material or are guided into and out of the circular-knitted material. In the circumferential direction, therefore, one or more additional yarns are knitted between two rows of stitches of the base knitted material to form additional stitches. Individual additional yarns are also present between pairs of stitch rows of the base knitted material seen the longitudinal direction of the knitted material. To make it more difficult for an additional yarn to be pulled all too easily out of the base material and thus to help prevent a run from developing, it is provided according to an advantageous elaboration of the invention that each additional yarn is anchored at both ends in the base knitted material. Each additional yarn is therefore integrated by appropriate knitting techniques in a sufficiently stable or secure manner into the base knitted material. This anchoring is preferably achieved by means of at least one catch and a float, wherein preferably several alternating catches and floats are used to realize the anchoring. The beginning and the end of the additional yarn therefore lie in the base knitted material by means of catches and floats and are therefore, by the use of appropriate knitting techniques, integrated into, i.e., guided within, the base knitted material, even though the yarn is not bound by stitches. The ends can project slightly from the base knitted material by one or a few millimeters on the side which faces the body when the article is being worn. Other knitting techniques besides catches and floats are also conceivable.

It is also possible to knit the additional stitches knitted with separate additional yarns, especially the additional stitch sections or subregions knitted with separate additional yarns, by the use of yarns which differ in color or in type. It is possible in this case to form, for example, sections or regions of different colors or regions which, because of the different type of additional yarns being used have, for example, different tactile properties. If additional yarns of the same color are knitted, the color of the additional yarns can differ from that of the base knitted material.

The yarn of the base knitted material and the additional yarn can be either elastic or inelastic. Two "equal" yarns can be knitted, such as an inelastic base material yarn and an inelastic additional yarn, but it is also conceivable an inelastic base material yarn could be combined with an elastic additional yarn or vice versa. It is also conceivable that the additional yarn could be an elastic or inelastic reinforcing yarn, knitted in stitch-forming fashion. This reinforcing yarn represents a plating. If the additional yarn is a separate yarn, the reinforcing yarn can also be a separate yarn.

Finally, it is conceivable that an elastic, especially a compression-producing weft yarn could be inserted into the stitches of the base knitted material. As a result of such an elastic weft yarn, the circular-knitted material acquires even more elastic properties, up to an including compressive properties. In the latter case, a compressive circular-knitted part is obtained.

In addition to the circular-knitted part itself, the invention also pertains to a method for the production of a circular-knitted part of the type described above. This method is characterized in that, using at least one yarn for the base knitted material, a circular-knitted part is knitted consisting of several rows of stitches which, seen in the longitudinal direction of the base knitted material, are stitched together and extend circumferentially in spiral fashion, wherein, seen in the longitudinal direction of the base knitted material, a stitch-forming additional yarn is interknitted between two rows of stitches of the base knitted material to form an additional stitch, thus connecting the rows of stitches, wherein the additional stitch is formed by a separate additional yarn.

The method can be carried out on a circular-knitting machine and also on a flat-knitting machine on which circular knitting is possible. As described above, of course, it is also possible to knit a large number of additional stitches, even in the form of rows of additional stitches, by means of separate additional yarns in certain sections. The additional yarns are interknitted into the base knitted material during the continuous knitting process at the appropriate location, so that the corresponding function-oriented or geometry-oriented region or regions are formed in the finished circular-knitted article.

In relation to a wale in which at least one additional stitch is provided, a stitch of a first row of stitches of the base material is knitted first, after which at least one additional stitch is knitted, after which the stitch of a second stitch row of the base material is knitted, wherein the additional stitch connects the two stitches of the first and second stitch row. Of course, this knitting pattern repeats until the desired number of additional stitches has been interknitted.

Seen in the longitudinal direction of the knitted material, at least one additional stitch can be knitted by means of at least one separate additional yarn between each of several pairs of stitch rows of the base material.

The additional stitches can be knitted between successive pairs of stitch rows, so that additional stitches and base material stitches alternate. Alternatively, the additional yarns can also be knitted between pairs of stitch rows separated from each other by two or more stitch rows. Finally, the additional stitches can also connect two stitch rows which are separated from each other by several stitch rows.

Also seen in the circumferential direction, furthermore, additional stitch row-forming additional stitches can be knitted between two stitch rows of the base material, these additional stitches being knitted with at least one common additional yarn or with at least one separate additional yarn in each case. Seen the circumferential direction, several additional stitch sections, each of which comprises several additional stitches, can be knitted between two stitch rows of the base material. The additional stitches or the additional stitch rows formed out of several additional stitches are therefore knitted section-by-section, i.e., offset from each other in the circumferential direction.

The additional yarns can be knitted in such a way that they or the additional stitches connect the successive stitches of the two stitch rows, or in such a way that they connect only every n-th stitch of the two stitch rows, wherein $n \geq 2$. In the latter case, the additional yarns float between the two additional stitches.

Within the scope of the production of the circular-knitted material, it is also conceivable that different subregions could be formed in which the additional yarns or additional stitches are knitted in different sequences with the stitches of the base material. Thus, a first subregion in which the additional yarns connect only every n-th stitch of the two stitch rows and at least one second subregion in which the additional yarns connect successive stitches of the two stitch rows can be knitted. These areas can ultimately be positioned in any desired way in the circumferential direction and/or longitudinal direction, and one can also lie within the other. Any desired geometries or relative positions of the subregions relative to each other can be realized.

An interknitted additional yarn is anchored at both ends in the base material, which is preferably done by catches and floats. Several alternating catches and floats are preferably used for the anchoring.

An elastic or inelastic base knitted material yarn and an elastic or inelastic additional yarn can be used, wherein the elasticities of the selected yarns do not have to be the same, although they can be the same. Another elastic or inelastic reinforcing yarn for the purpose of plating can also be knitted in stitch-forming fashion with the additional yarn, wherein this reinforcing yarn is preferably also a separate yarn, like the additional yarn.

Finally, an elastic, especially a compression-producing, weft yarn can be inserted into the stitches of the base knitted material to give the circular-knitted part an overall or locally defined elastic property, up to an including the property of producing compression.

All of the statements made concerning the circular-knitted part apply equally to the production method and vice versa.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

DETAILED DESCRIPTION OF THE INVENTION

Figure 1:
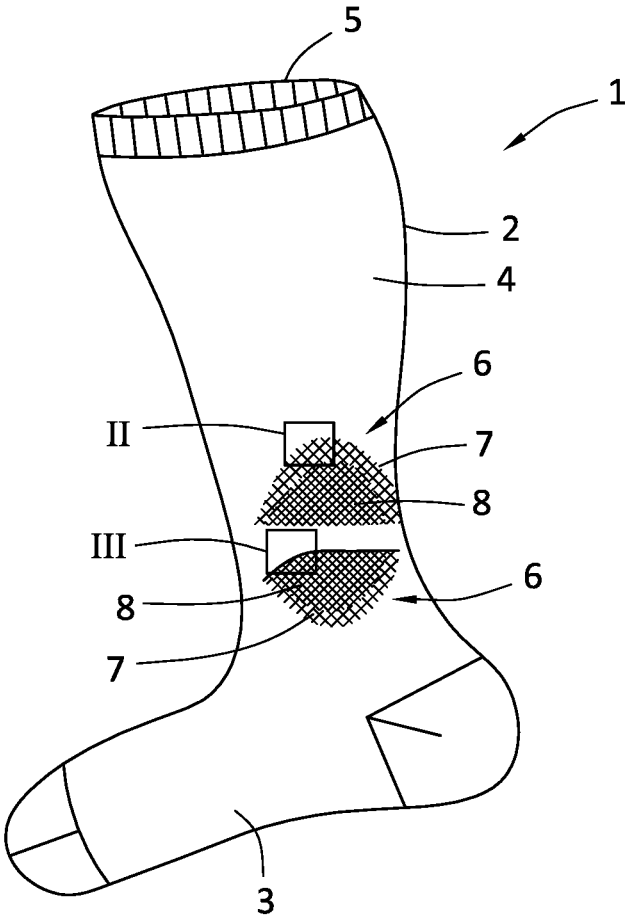
FIG. 1 shows a schematic diagram of a circular-knitted part according to the invention in the form of a stocking with two function-oriented or geometry-oriented regions, each consisting of two different subregions.

FIG. 1 shows a circular-knitted part 1 according to the invention in the form of a stocking 2, which comprises, in the known manner, a foot part 3 and a calf part 4, and which is closed off at the upper end by a top band 5. By way of example, two specific regions 6 are realized in the stocking region situated in the area of the ankle in the diagram; each of these regions consists of a first subregion 7 and a second subregion 8. In each of these regions 6 or subregions 7, 8 there is a plurality of separate additional yarns interknitted to form additional stitches or additional rows of stitches in the manner described below for the purpose of giving the regions 6 in question a specific functional orientation or to form a specific geometry. These separate additional yarns are interknitted—as will be discussed again later—into the base knitted material, which is knitted from at least one base knitting yarn, and which forms here the calf section 4.

Figure 2:
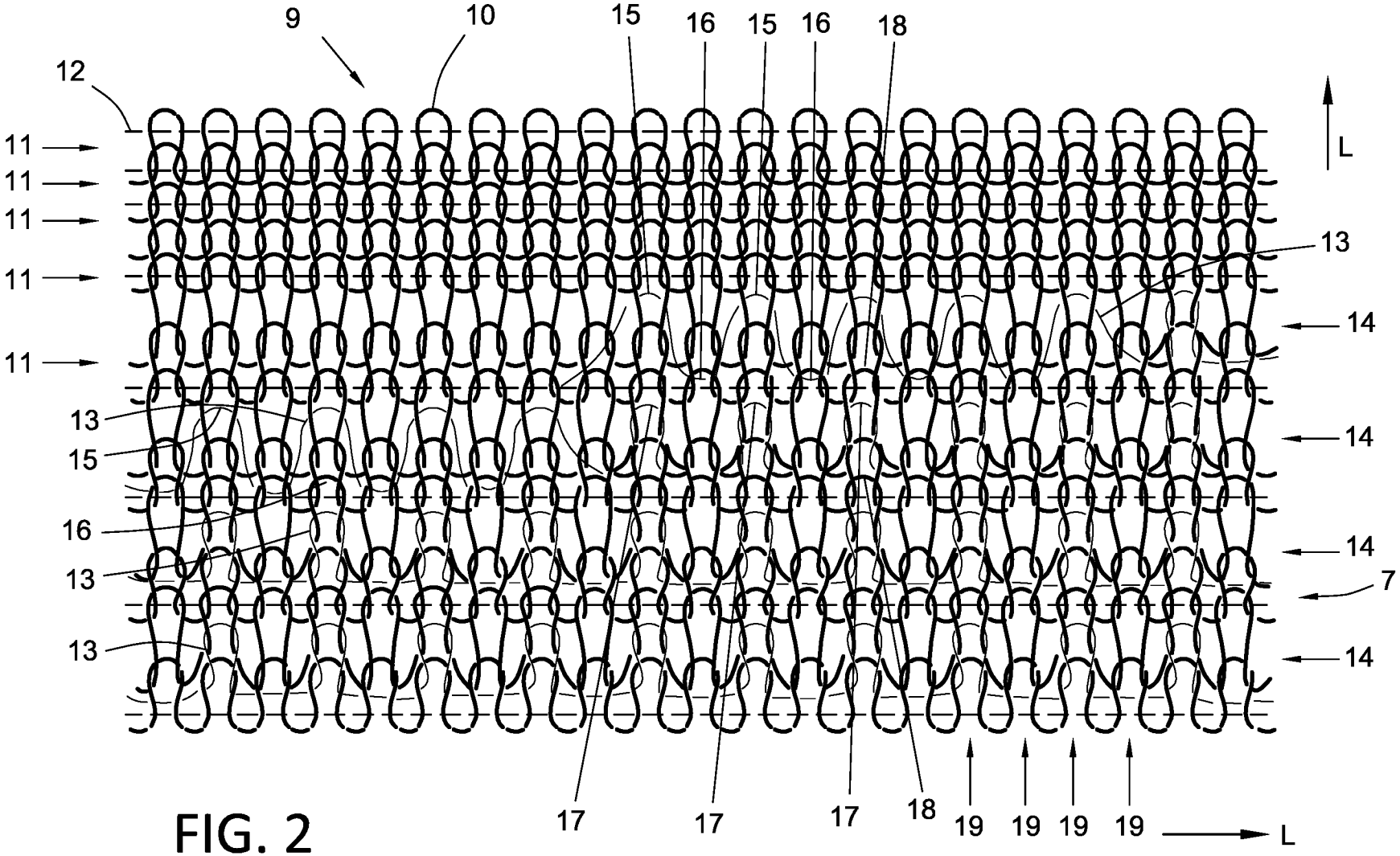
FIG. 2 shows a schematic diagram of the stitch pattern of section II of FIG. 1.

FIG. 2 shows by way of example a stitch pattern of section II of FIG. 1. This section shows the transition from the base knitted material 9 to the first subregion 7 of the upper region 6.

What is shown in the section according to FIG. 2 is a part of the base knitted material 9, which is knitted from a base knitting yarn 10 such as a sufficiently inelastic PA yarn. By way of example, an elastic weft yarn 12, which gives the base knitted material an elastic up to an including a compression-producing property, is knitted circumferentially into the individual stitch rows 11 of the base knitted material 9, which, because this is a circular-knitted part, extend in spiral fashion.

To form the knitted material region 7, several separate additional yarns 13 are knitted in the section shown between the stitch rows 11 of the base knitted material which are adjacent to each other in the longitudinal direction L of the knitted material. Separate rows 14 of additional stitches, consisting of several additional stitches 17, are interknitted by means of these separate additional yarns 13, and therefore the entire stitch volume in the region is increased. A defined increase in the number of stitches in this region is obtained—this region being geometrically defined and delimited, see FIG. 1. For the sake of clarity, the adjacent stitch rows 11 of the base material between which the additional stitch rows 14 are knitted are shown spread somewhat apart in the longitudinal direction L of the knitted material. Also in the longitudinal direction L of the knitted material, i.e., in the individual wale 19, an additional stitch row, as it were, is formed by the individual stitches 17, wherein all of the additional stitches on the wale side are knitted from different additional yarns 13.

Each additional yarn 13 is anchored at both ends (only one end of the additional yarn 13 is shown in FIG. 2) in the base knitted material 9. This is done by means of several catches 15 and floats 16, which alternate with each other. This anchoring prevents runs from forming in the stitches.

To form the additional stitch rows 14, the additional yarn 13 is first anchored and then knitted to form stitches The additional stitches 17 connect the stitches 18 of the adjacent stitch rows 11 of the base material. They are therefore knitted between these stitches. As can be derived from the stitch pattern of FIG. 2, the additional stitches 17 are knitted to every second stitch, i.e., on every second needle, so that the stitches 18 of the base material adjacent to the additional stitches 17 in the circumferential direction U are still stitched directly together. Seen in the circumferential direction U, therefore, additional stitches 17 and base material stitches 18 alternate. This also applies when seen in the longitudinal direction L of the knitted material, i.e., in the direction of the individual wales 19. Only base knitted material stitches 18 are present in the wales 19 into which no additional stitches are interknitted. As a result of the interknitting of the additional stitches 17, i.e., the formation of the additional stitch rows 14, the stitch volume in the subregion 7 is therefore increased. Instead of the 1:1-alternation of additional stitches 17 and base material stitches 18 shown here, it is obviously also conceivable that, for example, two or three additional stitches 17 could be knitted one after the other, followed by one, two, or three base knitted material stitches 18, etc. Any desired sequence can be realized.

Each additional yarn 13 is also anchored at the other end (not shown) in the base knitted material.

As can be seen, the additional stitches 17, i.e., the additional stitch rows 14, are interknitted only partially, i.e., on a section-by-section basis seen in the circumferential direction U, into the base knitted material 9. The circumferential length ultimately determines the width of the regions. The height of the region is defined by the corresponding number of additional yarns 13 knitted in the longitudinal direction L of the knitted material.

Figure 3:
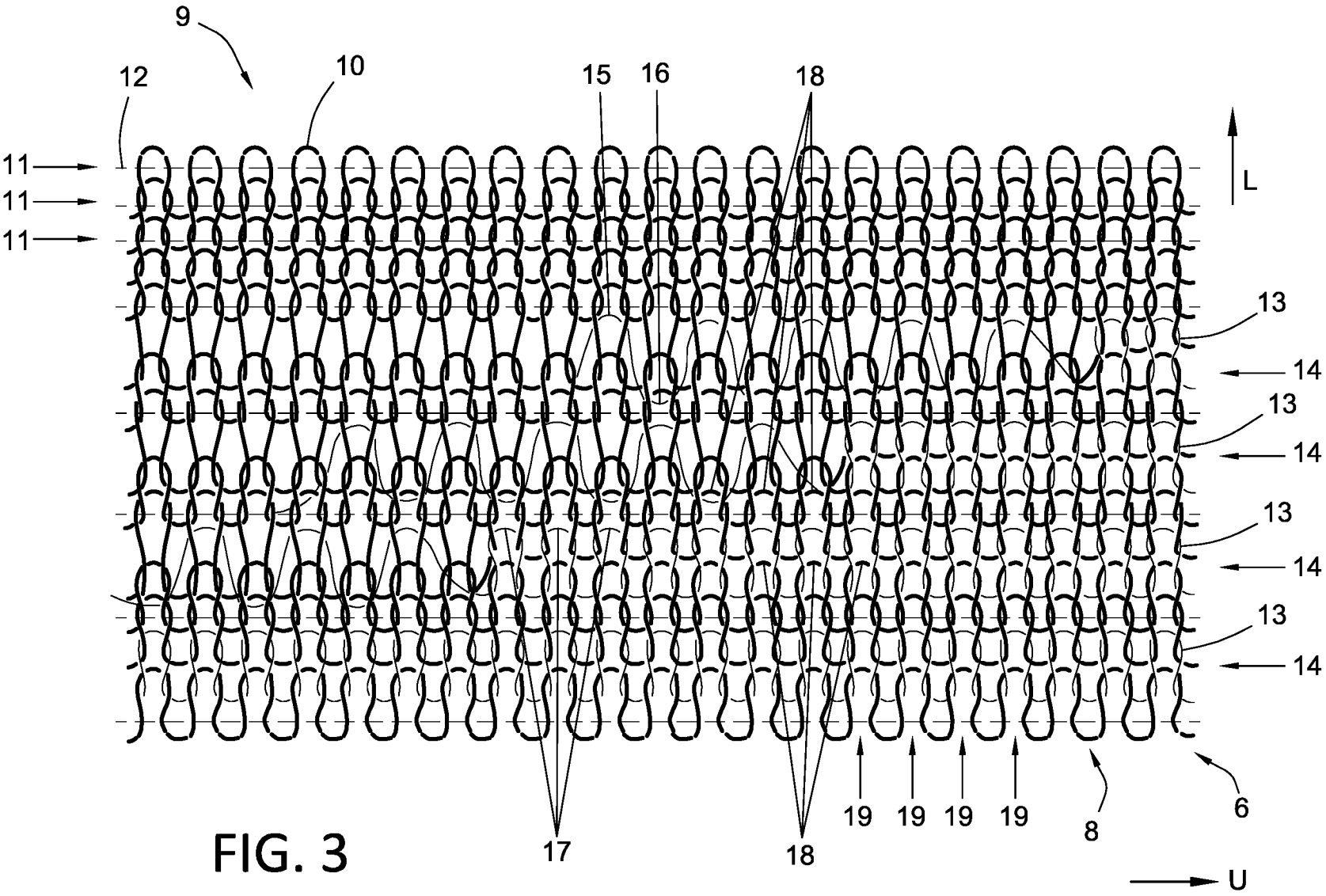
FIG. 3 shows a schematic diagram of the stitch pattern of section III of FIG. 1.

FIG. 3 shows a stitch pattern of section III of FIG. 1. Whereas FIG. 2 shows the transition from the base knitted material 9 to the first subregion 7, FIG. 3 shows the transition from the base knitted material 9 to the second subregion 8 of region 6. The base knitted material 9 has been produced as described from a base knitting yarn 10; the base knitting stitch rows 11 are also provided here with a weft thread 12 passing around the circumference in spiral fashion. Here, too, additional stitch rows 14 comprising a plurality of individual additional stitches 17 are interknitted between several circular-knitted stitch row pairs by the use of a separate additional yarn 13 in each case. Each separate additional yarn 13 is anchored in the base knitting 9 here, too, by anchor points, i.e., by a catch 15 and a float 16, to prevent runs. This also applies here, of course, to both ends of each additional yarn 13.

The additional stitches 17 proceed from the anchoring in question, wherein here all of the base knitting stitches 18 of the two adjacent base material stitch rows 11 are connected to each other by additional stitches 17; that is, the additional stitch row 14 in question connects over its entire length the two adjacent base material stitch rows 11. The number of additional stitches 14 is therefore much larger in subregion 8 than in subregion 7. This has the result that subregion 8 in turn has properties different from those of the subregion 7, which can be seen as equivalent to a transition region.

As can be seen, as a result of the interknitting of the additional stitches 17 or additional stitch rows 14, a local increase in the stitch volume is obtained. If sufficient additional volume has been interknitted, a corresponding change in the geometry of the knitted material is obtained, so that in this way corresponding curvatures or the like, i.e., geometric effects, can be realized, which make it possible for the article to be adapted more effectively to the anatomy of the body section to be covered by the region. This increases the wearing comfort, and it also contributes to whatever therapeutic effect is to be achieved.

Whereas the individual additional stitches 17 or additional stitch rows 14 in the figures are introduced only between every second stitch row pair of the base knitted material, seen in the longitudinal direction L of the knitting, it is obvious that the additional stitch rows 14 could also be introduced between every successive stitch row pair of the base knitted material or only between every third pair, etc.

As FIG. 1 shows, the two subregions 7, 8 are directly adjacent to each other. Seen the circumferential direction U of the circular-knitted part 1, this means that the additional yarn 13 in question is knitted first on the basis of the stitch pattern shown in FIG. 2 to form stitches, i.e., only to every second stitch of the base knitting 9, i.e., on every second needle. With the transition to the second subregion 8, then, the stitch pattern changes abruptly: the additional yarn 13 in question is now knitted to each base knitting stitch or on each needle, so that the stitch pattern corresponds to that of FIG. 3. When the second subregion 8 transitions back to the first subregion 7, then the stitch pattern changes back again to that of FIG. 2, after which this subregion 7 transitions back to the base knitting 9

That these different subregions adjoin each other, however, is not mandatory. It is obvious that they can also be a certain distance apart and that only the one or the other knitting method can be used to realize the one or the other subregion.

Although FIG. 1 shows an over-the-calf stocking, the circular-knitted part can obviously also have any other desired form. It can be a complete leg stocking, an arm stocking, or a body part. For all of these circular-knitted parts it is conceivable that corresponding function-specific or geometry-specific regions can be formed.

While specific embodiments of the invention have been shown and described in detail to illustrate the inventive principles, it will be understood that the invention may be embodied otherwise without departing from such principles.

I claim:

1. A circular-knitted part, comprising:

a base knitted material knitted having at least one base knitting yarn knitted in a circumferential direction into a plurality of rows of stitches of the at least one base knitting yarn, the rows being knitted together and extending spirally, the rows knitted together forming a tubular part that extends in a longitudinal direction, and an additional yarn partially interknitted in the circumferential direction between several pairs of the plurality of rows of stitches of the base knitted material, the additional yarn forming a respective at least one additional stitch connecting each pair of the several pairs of the plurality of rows of stitches of the at least one base knitting yarn, the additional yarn being disposed entirely between the several pairs of the plurality of rows of stitches and extending less than a circumference of the tubular part, and the additional yarn forming at least two additional stitch rows starting in different stitch wales.

2. The circular-knitted part according to claim 1, wherein the additional stitches are knitted between successive ones of the pairs of stitch rows, or the additional stitches are knitted between stitch row pairs separated from each other by two or more stitch rows, or the additional stitches connect two stitch rows which are separated from each other in the base knitted material by more than one of the stitch rows.

3. The circular-knitted part according to claim 1, wherein a plurality of the additional stitches are knitted between the each pair of the several pairs of the plurality of stitch rows of the base knitted material in the circumferential direction.

4. The circular-knitted part according to claim 3, wherein a plurality of additional stitch sections, each comprising several additional stitches of the additional yarn, are formed between two stitch rows of the base knitted material.

5. The circular-knitted part according to claim 3, wherein the additional stitches connect successive stitches of the two stitch rows, or the additional stitches connect only every n-th stitch of the two stitch rows, where $n \geq 2$.

6. The circular-knitted part according to claim 5, wherein the additional yarn connects only every n-th stitch floats between two of the additional stitches.

7. The circular-knitted part according to claim 5, wherein a region of the base knitted material in which the additional yarns are knitted comprises at least one first subregion, in which the additional yarns connect only every n-th stitch of the two stitch rows in each case, and at least one second subregion, in which the additional yarns connect the successive stitches of the two stitch rows in each case.

8. The circular-knitted part according to claim 7, wherein the subregions adjoin each other in at least one of the circumferential direction and the longitudinal direction of the base knitted material, are separated from each other, or lie in each other and either adjoin each other or are separated from each other.

9. The circular-knitted part according to claim 1, wherein further additional stitches are knitted with separate strands of the additional yarn, and are knitted with separate strands of different colors or types.

10. The circular-knitted part according to claim 1, wherein the additional yarn is anchored at both ends in the base knitted material.

11. The circular-knitted part according to claim 10, wherein each end of the additional yarn is anchored by at least one catch tucked behind one of the stitches in the base knitted material and one float.

12. The circular-knitted part according to claim 1, wherein the base knitting yarn and the additional yarn are elastic.

13. The circular-knitted part according to claim 1, further comprising a supplemental elastic reinforcing yarn knitted in stitch-forming fashion with the additional yarn.

14. The circular-knitted part according to claim 1, further comprising an elastic weft yarn inserted into the stitches of the base knitted material.

15. A method for producing a circular-knitted part according to claim 1, comprising the steps of:

knitting a base knitted material having several stitch rows using at least one base knitting yarn, the rows being knitted together when seen the longitudinal direction of the base knitted material and extending spirally, partially interknitting an additional yarn, which forms stitches between several pairs of the plurality of stitch rows of the base knitted material, the additional yarn forming at least one additional stitch between each of the several pairs of the plurality of stitch rows of the base knitted material, the additional yarn being disposed entirely between the several pairs of the plurality of stitch rows and extending less than a circumference of the tubular part.

16. The method according to claim 15, wherein, in relation to a wale in which at least one additional stitch is provided, the stitch of a first stitch row is knitted first, after which at least one additional stitch is knitted, after which the stitch of a second stitch row is knitted, wherein the additional stitch connects the stitches of the first and second stitch rows.

17. The circular-knitted part according to claim 1, wherein the base knitting yarn and the additional yarn are inelastic.

18. The circular-knitted part according to claim 1, further comprising a supplemental inelastic reinforcing yarn knitted in stitch-forming fashion with the additional yarn.

* * * * *